United States Patent [19]

Donnell, Jr.

[11] Patent Number: 4,913,488

[45] Date of Patent: Apr. 3, 1990

[54] CONVERTIBLE BENCH AND TABLE TOP ASSEMBLY

[75] Inventor: Emerson B. Donnell, Jr., Neshanic, N.J.

[73] Assignee: Nelson A. Taylor Co., Inc., Gloversville, N.Y.

[21] Appl. No.: 298,425

[22] Filed: Jan. 18, 1989

[51] Int. Cl.[4] ..... A47B 85/04

[52] U.S. Cl. ..... 297/124; 297/126

[58] Field of Search ..... 297/124, 126; 108/78, 108/77, 69

[56] References Cited

U.S. PATENT DOCUMENTS

| | | | |
|---|---|---|---|
| 2,506,606 | 5/1950 | McCaw | 297/124 |
| 2,714,743 | 8/1955 | Lochner | 108/78 X |
| 2,897,876 | 8/1959 | Austin | 297/124 X |
| 2,959,209 | 11/1960 | Lakin | 297/124 |
| 3,361,470 | 1/1968 | Gustin et al. | 297/124 |
| 4,194,784 | 9/1980 | Dostal et al. | |
| 4,735,151 | 4/1988 | Bishing | 108/69 |

*Primary Examiner*—Francis K. Zugel

*Attorney, Agent, or Firm*—Nixon & Vanderhye

[57] ABSTRACT

A locking member for use on a article of furniture, the article of furniture having frame means carrying a fixed seat section and a movable common section, the support member rotatably mounted on the frame and movable from a first non-locked seat back position to a second locked table top position, the support member being maintained in its first non-locked seat back position by gravity, and in its second locked table top position by the locking member. The support member comprises a box-shaped housing member rotatably carried on the frame means, with the locking member loosely contained between the frame member and the housing member for rotational movement with the housing member. The locking member is longitudinally movable from a first non-wedging position to a second wedging position to lock by wedging action the support member in its second or table top position. The locking member is further provided at a forward end thereof with retention means cooperable with surface means on the housing member to retain the locking member in the second position.

15 Claims, 3 Drawing Sheets

FIG. 1
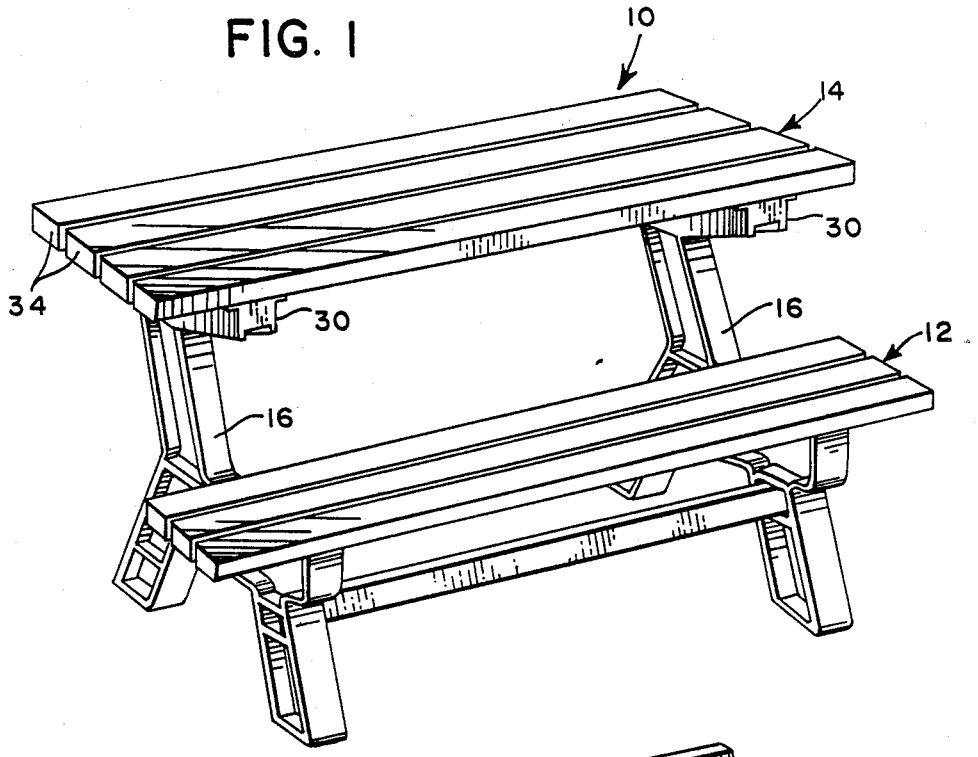
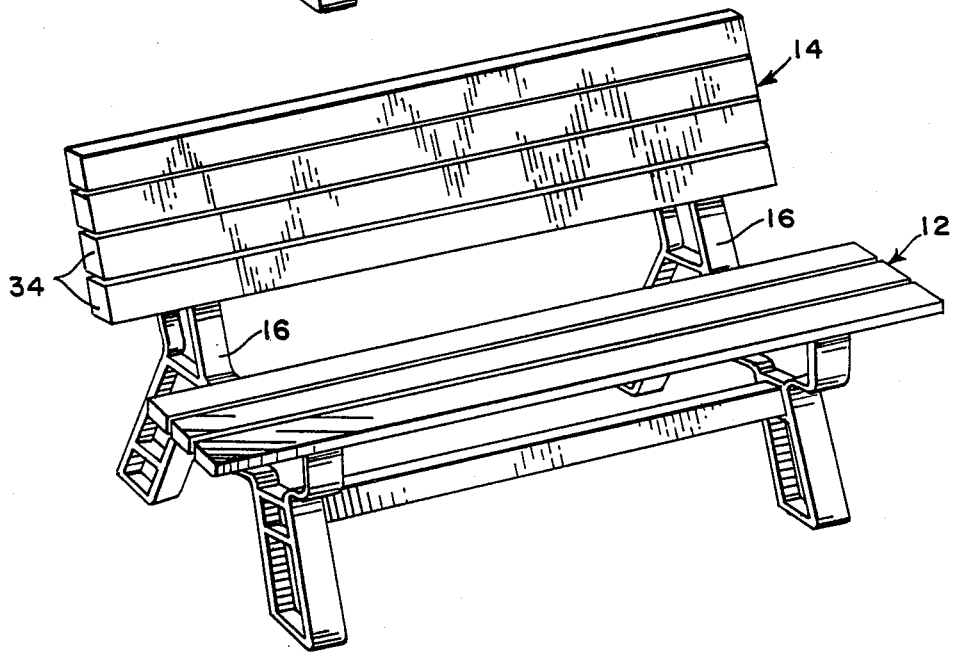
FIG. 2

FIG. 3
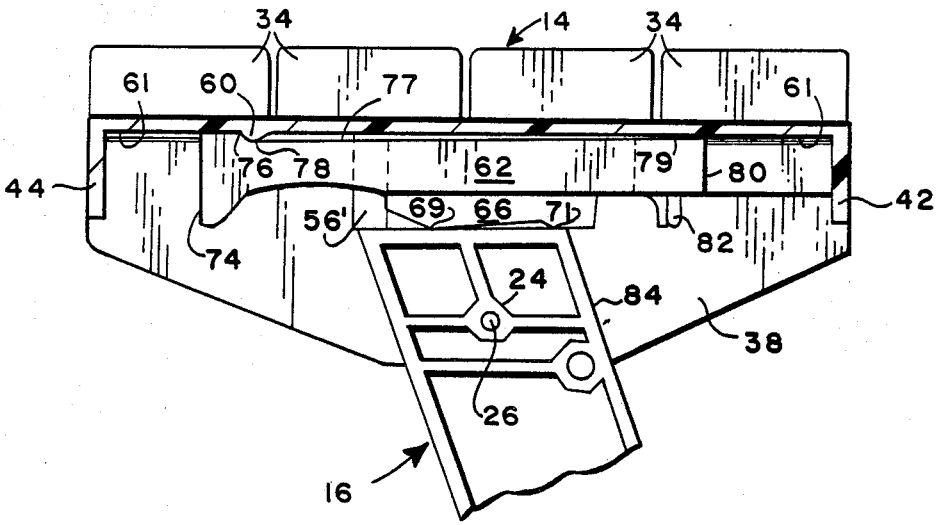
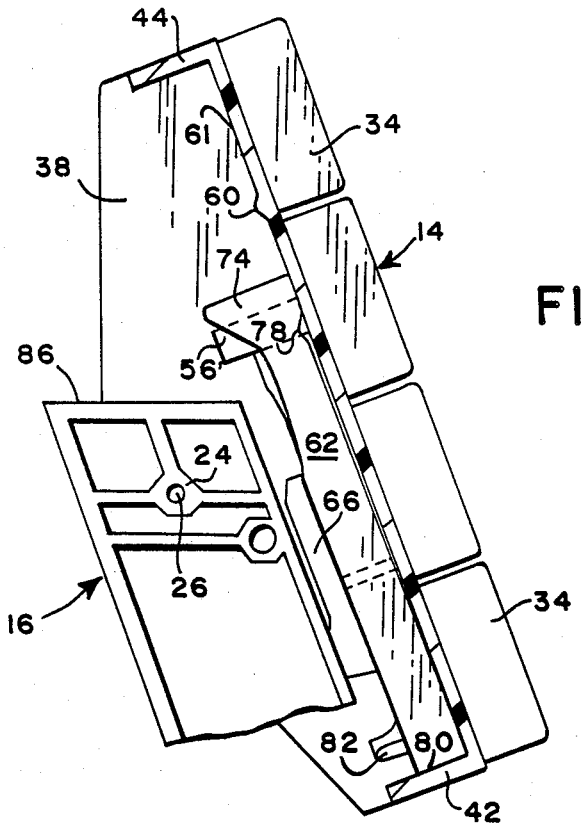
FIG. 4

FIG. 6
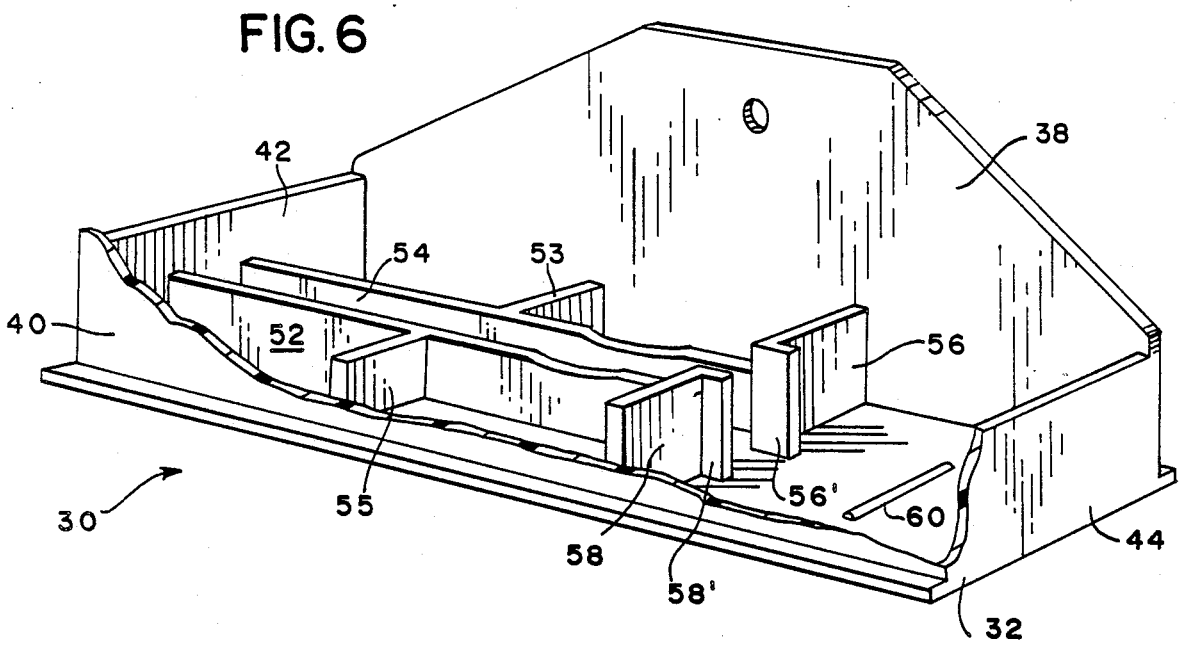
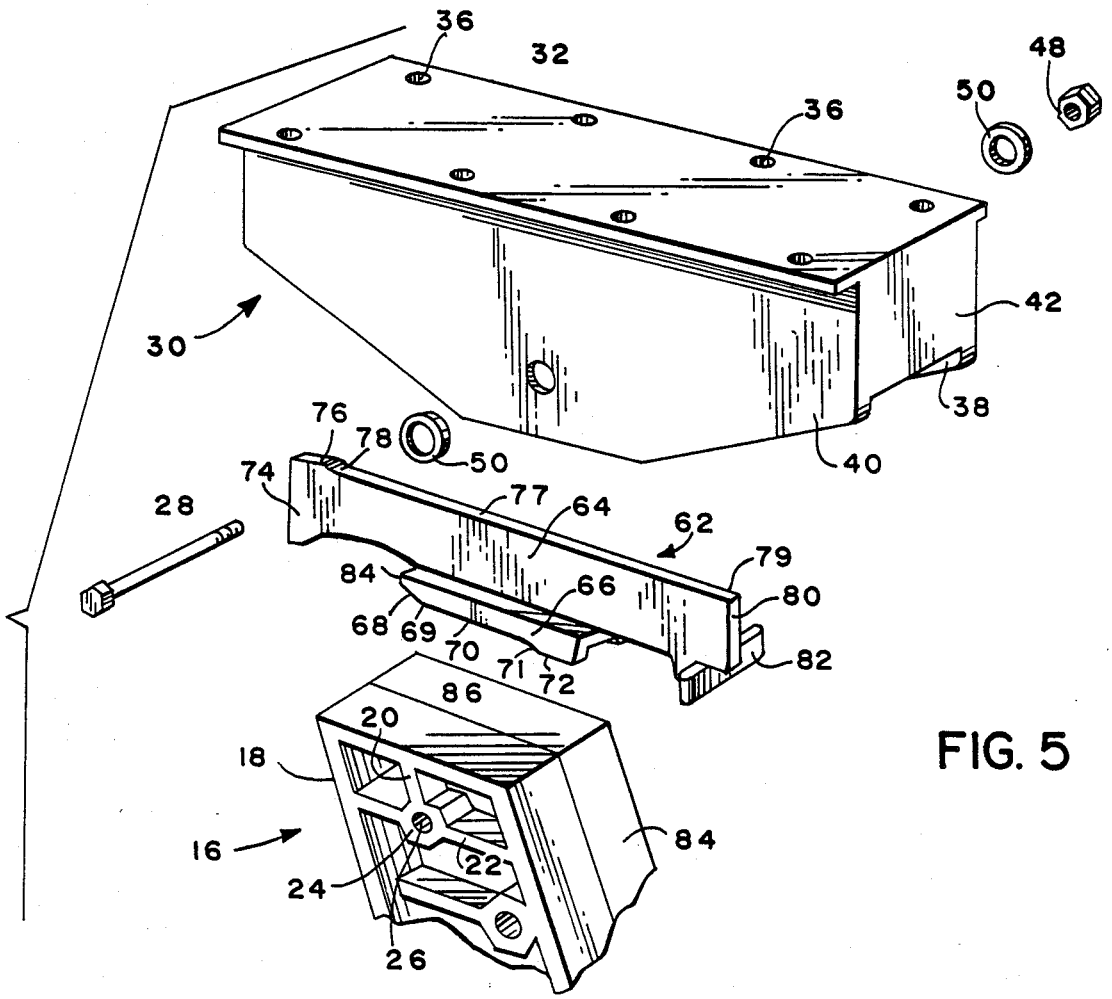
FIG. 5

CONVERTIBLE BENCH AND TABLE TOP ASSEMBLY

BACKGROUND AND SUMMARY OF THE INVENTION

The present invention relates to a combination bench/table assembly wherein a common section of the assembly alternatively serves as either a seat back or a table top. More specifically, this invention relates to an improved locking arrangement for securing the common section in its position as a table top.

Bench or seat backs convertible to table tops are known in the art, as disclosed in U.S. Pat. No. 4,194,784 and assigned to the assignee of the present invention. In this prior construction, and at each end of the common section, a slidable locking member is provided which includes a wedge portion adapted to be wedged between an upstanding stanchion and a cross-arm support member.

The present invention provides additional means by which the slidable locking member is maintained in its table top orientation until it is retracted to an inoperative position by a user, thereby allowing the common section to be pivoted to a seat back position. In one exemplary embodiment, the forwardmost portion of the locking member is provided with an upper surface configuration which defines a detent which passes over and behind a cooperating projection on an interior surface of a cross arm support member to reliably lock the common section in its table top orientation.

Other cooperating surface configurations could also be utilized to perform the same function and, therefore, the invention is not limited solely to the exemplary embodiment disclosed herein.

Additional objects and advantages of the invention will become apparent from the detailed description which follows.

BRIEF DESCRIPTION OF THE DRAWINGS

FIG. 1 is a perspective view of a structure incorporating a locking member in accordance with this invention, wherein a common section is in a table top position;

FIG. 2 is a perspective view similar to FIG. 1, but showing the common section in a bench or seat back position;

FIG. 3 is a partial section view of a cross arm support member and a locking member in accordance with the invention, in a table top position;

FIG. 4 is a partial section view of a cross arm support member and locking member in accordance with the invention in a bench or seat back position;

FIG. 5 is a is an exploded view of the cross arm support member and locking member in accordance with the invention; and FIG. 6 is a cutaway view of the cross arm support member shown in FIG. 5.

DETAILED DESCRIPTION OF THE DRAWINGS

Referring to FIG. 1, there is shown a table assembly 10 which, in a preferred embodiment, is in the form of a picnic table having a seat section 12 and a convertible table/seat back section 14 (also referred to herein as the common section). The seat section may be mounted in any conventional way on suitable leg and frame structure, while the common section is pivotally carried on a pair of upstanding stanchion members 16, which may comprise an integral or separable part of the leg and frame structure. Since each stanchion 16 and the manner in which the common section 14 is pivotably mounted thereto are identical, only one need be described herein in detail.

With reference now to FIGS. 3, 4 and 5, it may be seen that each stanchion member 16 has an upper end 18 which includes web portions 20, 22, which intersect at an enlarged area 24 provided with a throughbore 26.

The particular structural configuration and composition of the stanchions 16 are not critical to this invention, e.g., they may be of solid wood construction, extruded metal, or as in the exemplary embodiments disclosed herein, molded plastic. In any event, bore 26 mounts a bolt or pivot pin 28 which serves to pivotably mount a cross arm support member or bracket 30.

The cross arm support member 30 is formed with a flat top surface 32 which, in a typical picnic table configuration, supports a plurality of elongated slats or boards 34 by means of bolts or screws (not shown) passed through a plurality of apertures 36. The cross arm support member 30 is further provided with a pair of laterally spaced side walls 38, 40, and a pair of end walls 42, 44, so that the support member 30 takes on the appearance of an open-ended box.

Side walls 38, 40 are provided with a pair of aligned apertures 46 so that when the cross arm support member 30 is located so that side walls 38, 40 overlap the upper end of stanchion 16, apertures 46 may be aligned with bore 26 so that bolt or pin 28 may be passed therethrough and secured by nut 48 and associated washers 50. Of course, other conventional pivot pin arrangements are suitable as well.

Located on the underside of top wall 32 are a pair of elongated guide walls 52, 54 which extend from the end wall 42 toward the opposite end wall 44. Reinforcing walls 53, 55, 56 and 58 extend transversely of the guide walls 52, 54 and provide added rigidity to the support member as a whole, as well as to the guide walls 52, 54. With reference to FIG. 6, it will be seen that the elongated guide walls 52, 54 terminate short of the opposite end wall 44 of the cross arm support member 30 at their intersection with the reinforcements 56, 58. The latter are provided with guiding flanges 56', 58', respectively which extend toward the end wall 44 coaxially with guide walls 52, 54.

The underside of top wall 32 is also provided with an elongated, projecting rib or rib 60 which is located intermediate the reinforcing walls 56, 58 and end wall 44. The projecting rib extends transversely of the guide walls 52, 54 and flanges 56', 58' for a purpose described below.

With reference now to FIG. 5, it may be seen that an elongated locking member 62 is formed with an elongated body portion 64, from which depends a wedging member 66 provided with wedging surfaces 68, 70, and 72 which define a pair of lateral contact edges or corners 69, 71. Along the upper surface of the elongated body portion 64, a forward end 74 is provided which includes a projection 76, which extends above the remaining upper surface portion 77 of the body portion 64, thereby forming a detent 78 which is designed to receive the projecting rib 60 when the locking member is in its fully locked position.

The rearward end 80 of the locking member 62 is provided with a cross-piece 82 which serves as a handle to be used when inserting or retracting the locking member.

With reference again to FIG. 4, the common section 14 is shown in a position where it serves as a seat back for the seat section 12. In this position, the locking member 62 is slidably and somewhat loosely received between the cross arm support member 30 and an upstanding wall 84 of stanchion 16 with its rearward end 80 abutting the interior of the end wall 42.

In moving the common section 14 to a table top position, the cross arm support members at either end of the common section 30 are rotated about their respective pivot pins or bolts 28 to the position shown in FIG. 3. Once the common section is in a horizontal position, each locking member 62 is pushed forward with the aid of handle 82 within the guide walls 52, 54. As the locking member 62 moves forward, projection 76 on locking member 62 contacts projecting rib 60 on cross arm support member 30. Further movement forward causes projection 76 to ride over rib 60. This is accomplished by the corner 69 of wedging member 66 contacting the upper surface 86 of stanchion 16 and the corner 79 of locking member 62 contacting the surface 61 of cross member 30 and creating a flexible beam effect for locking member 62. This flexibility is preferred to limit forces on the rib 60 and projection 76 in order to maintain original dimensions and thus the reliability of the locking action. When locking member 62 has been moved fully forward, rib 60 is received in detent 78 immediately behind projection 76, projection 76 and corner 79 maintain contact with surface 61, corner 69 of wedging member 66 remains in contact with surface 86 of stanchion 16, and corner 71 of wedging member 66 has moved into contact with surface 86, causing the flexible beam effect to be maintained and therefore a spring load to be applied at all points of contact. In this manner, each locking member 62 is prevented from working itself loose and otherwise allowing the common section 14 to rotate back into a seat back orientation.

It is also noted that the forward reinforcing elements 56,58 serve as stop elements against which a forward surface 84 of wedging member 66 abuts when each locking member 62 is in its fully locked position as shown in FIG. 3.

When it is desired to move the common section from its table top position shown in FIG. 3 to the seat back position shown in FIG. 4, the handle like element 82 at the rearward ends of each locking member 62 is pulled rearwardly to disengage the wedging members 66 from between the support members 30 and the stanchions 16, so that the common section 14 may be rotated counterclockwise to its seat back position shown in FIG. 4.

It will be appreciated that other means may be utilized to perform the retaining function of projections 76, detent 78 and rib or projection 60. For example, it is also contemplated that a detent or recess could be formed in the interior of top wall surface 32 for receiving a projection similar to that shown at 76 on the locking member.

In the preferred embodiment, the stanchions 16, cross arm support members 30 and elongated locking members 62 are all rigidly formed of injection molded polyethylene. However, it is to be understood that other suitable materials may also be utilized.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A locking member for use on a article of furniture, said article of furniture having frame means carrying a fixed seat section and a movable common section, said common section rotatably movable on said frame from a first non-locked seat back position to a second locked table top position, said common section maintained in its first non-locked seat back position by gravity, said common section maintained in its second locked table top position by said locking member, said locking member being associated at least one support member attached to said common section, said support member comprising a box-shaped housing member rotatably carried on said frame means, said locking member loosely contained between said frame member and said housing member for rotational movement with said housing member, said locking member longitudinally movable from a first non-wedging position to a second wedging position to lock by wedging action said common section in its second position, said wedging action resulting from said locking member being slidably moved longitudinally within said housing member to a position where it is wedged between said housing member and a planar portion of said frame member when said support member is in its second position, and wherein said locking member is provided at a forward end thereof with retention means cooperable with surface means on said housing member to retain said locking member in said second position.

2. The invention of claim 1 wherein said housing member is provided with a raceway for guiding said slidable locking member.

3. The invention of claim 2 wherein said slidable locking member comprises an elongated member having an upper surface and a lower surface, said retention means being formed on said upper surface .

4. In a combination bench and table top assembly wherein a common section of the assembly is movable between a first position wherein said common section functions as a table top, and a second position wherein said common section functions as a seat back, and wherein said assembly further includes a frame, a support member pivotally mounted on said frame, and a locking member provided with wedging means and slidable within said support member between said support member and said frame to lock said support member in the table top position, the improvement comprising detent means on said locking member cooperable with projection means on said support member, and flexible action of said locking member, thereby enhancing the locking action of the locking member in the table top position, and limiting surface pressures on said detent means and said projection means during engagement and disengagement, thereby minimizing wear on said detent and projection means.

5. The combination according to claim 4 wherein said support member includes guide means for slidably receiving said locking member.

6. The combination according to claim 4 wherein said support member comprises an open channel shaped body portion including a top wall, a pair of side walls and at least one end wall, and wherein said projection means are formed on an interior surface of said top wall.

7. The combination according to claim 4 wherein said top wall at least partially supports a plurality of elongated slats or boards.

8. The combination according to claim 4 wherein said support member is provided with apertures in said sidewalls for receiving pin means pivotally attaching said support member to said frame.

9. The combination according to claim 4 wherein said wedging means comprises a wedge member depending from said locking member intermediate forward and rearward portions thereof, and wherein said wedge member is provided on a lower surface with longitudinally spaced contact edges.

10. The combination according to claim 9 wherein said wedge member further comprises an abutment surface at its forward end cooperable with reinforcing means in said support member to limit forward sliding movement of said locking member.

11. The combination according to claim 10 wherein said locking member is provided with handle means at its rearward end.

12. A locking device for use on an article of furniture, said article of furniture having frame means carrying a seat member and a movable support member, said movable support member pivotally mounted by pivot means on said frame for movement between a first seat back position and a second table top position, said locking device comprising an elongated body portion having handle means at a rearward end thereof, a first locking means at a forward end thereof, and a second locking means intermediate the forward and rearward ends thereof.

13. A locking device according to claim 12 wherein said first locking means comprises a detent formed in an upper surface of said elongated body portion.

14. A locking device according to claim 13 wherein said second locking means comprises a wedging member extending downwardly from a lower surface of said main body portion, said wedging member being formed with a plurality of wedging surfaces.

15. A locking device according to claim 13 in combination with the moveable support member and wherein the support member is provided with projection means on an interior surface thereof cooperable with said detent to releasably lock said support member in a table top position.

* * * * *